US005265555A

United States Patent [19]

Hodge, Jr.

[11] Patent Number: 5,265,555

[45] Date of Patent: Nov. 30, 1993

[54] BASS BOAT KIT APPARATUS

[76] Inventor: Lonnie S. Hodge, Jr., Rte. #1, Box 211-B, Henry, Tenn. 38231

[21] Appl. No.: 944,288

[22] Filed: Sep. 14, 1992

[51] Int. Cl.[5] ..... B63B 3/09

[52] U.S. Cl. ..... 114/343; 114/352; 114/357

[58] Field of Search ..... 114/343, 352, 354, 355, 114/356, 357, 358, 364

[56] References Cited

U.S. PATENT DOCUMENTS 957,820 5/1910 Vaniman ..... 114/352
1,595,096 8/1926 Hooker ..... 114/354
2,994,891 8/1961 Przybylski ..... 114/354
3,152,342 10/1964 Harrington ..... 114/354
4,052,761 10/1977 Rilling ..... 114/352
4,821,667 4/1989 Hargett ..... 114/357

*Primary Examiner*—David M. Mitchell
*Assistant Examiner*—Stephen P. Avila
*Attorney, Agent, or Firm*—Leon Gilden

[57] ABSTRACT

A plurality of inserts are arranged for mounting within a hull of a boat member between a bow and stern plate of the hull. The inserts are arranged for mounting to the side walls of the hull and are interlocked relative to one another to convert the hull to a bass boat configuration.

6 Claims, 6 Drawing Sheets

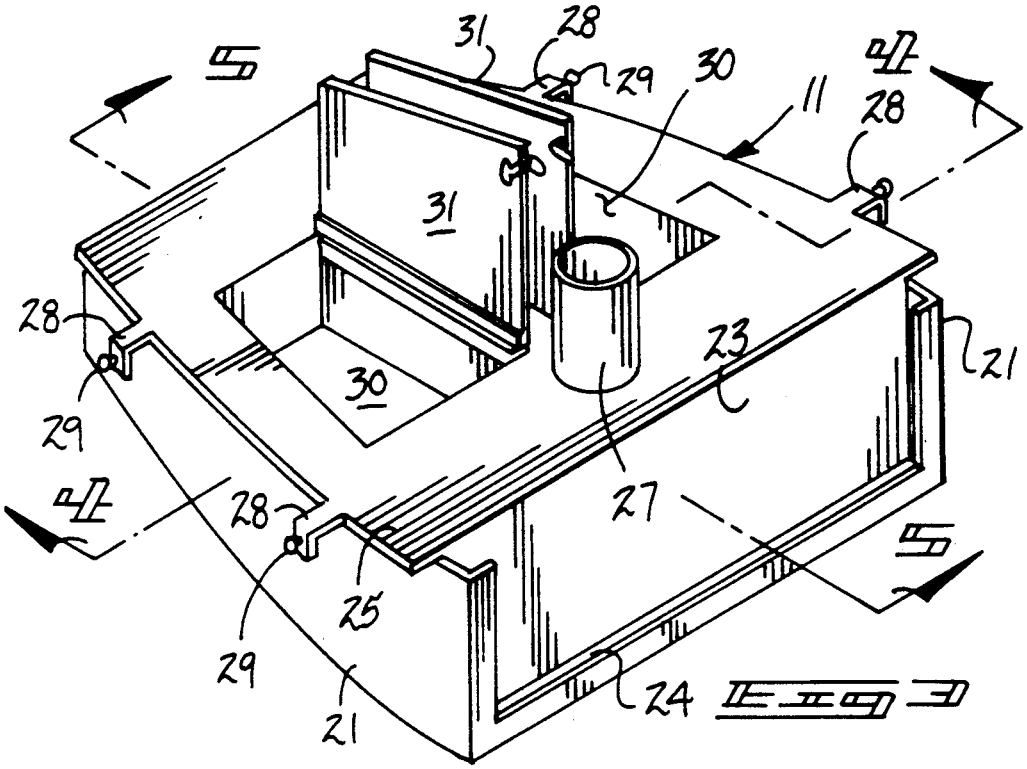
FIG 3
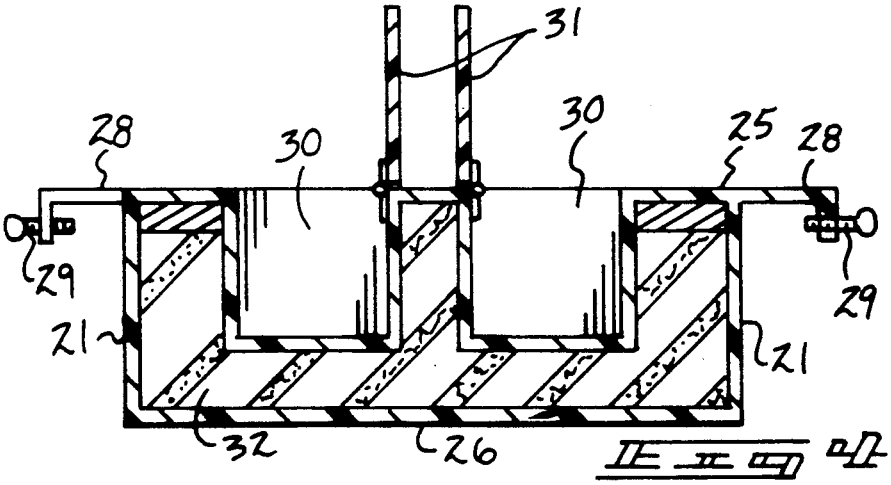
FIG 4
FIG 5
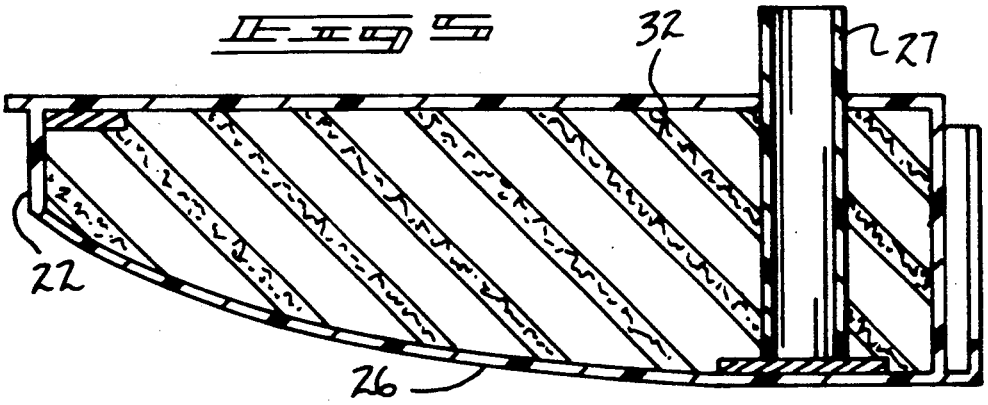

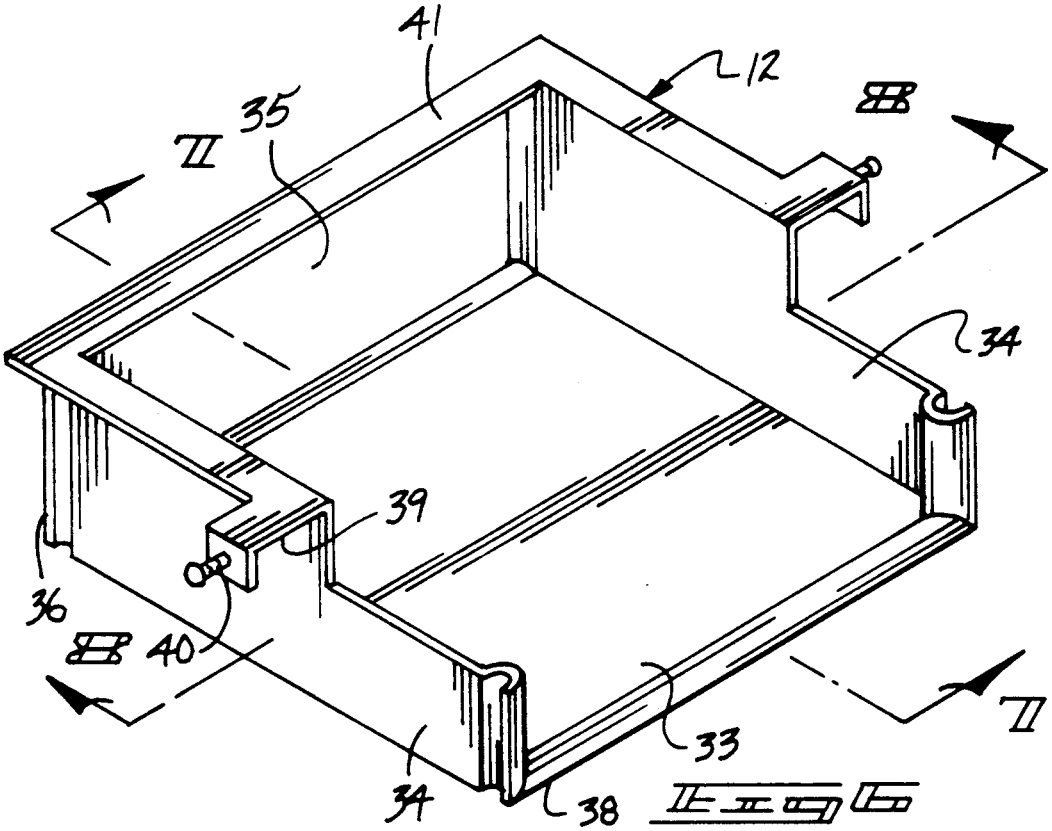
Fig 6
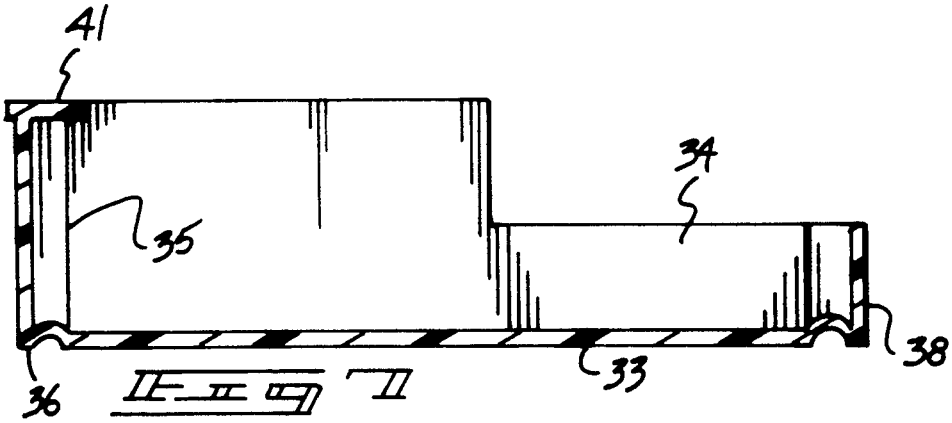
Fig 7
Fig 8
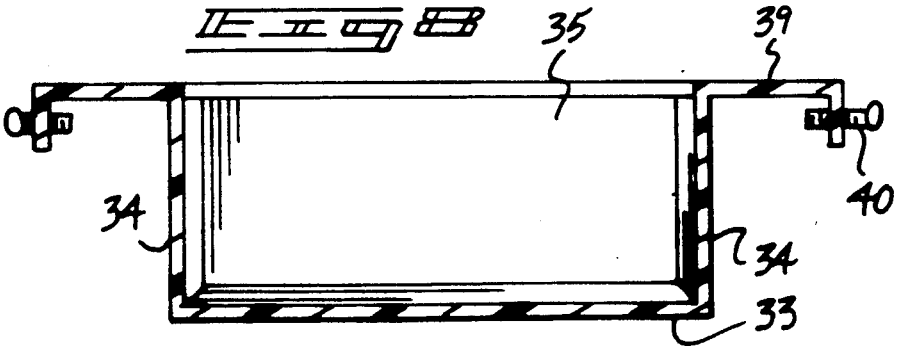

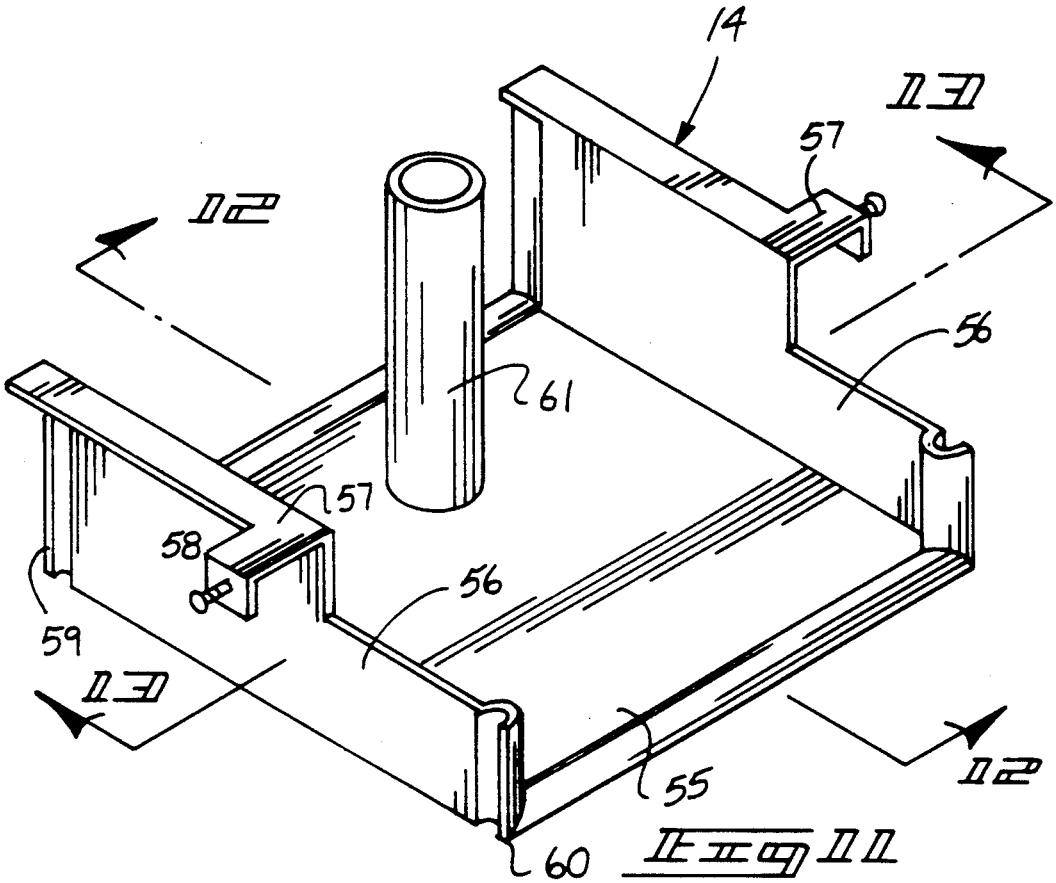
Fig 11
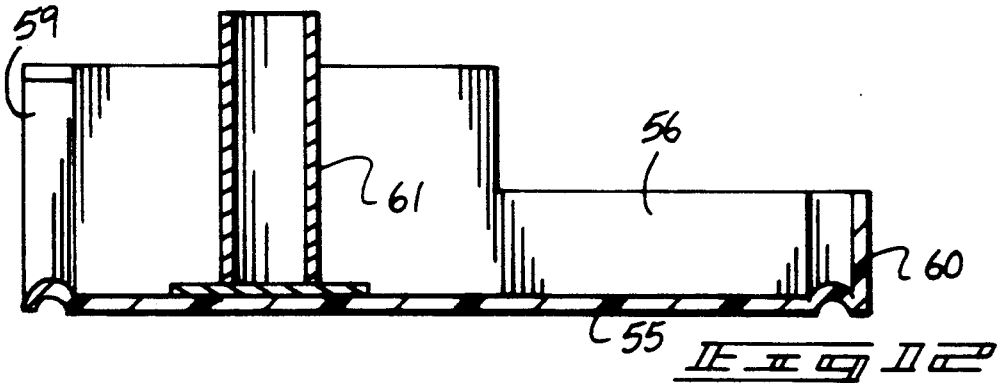
Fig 12
Fig 13
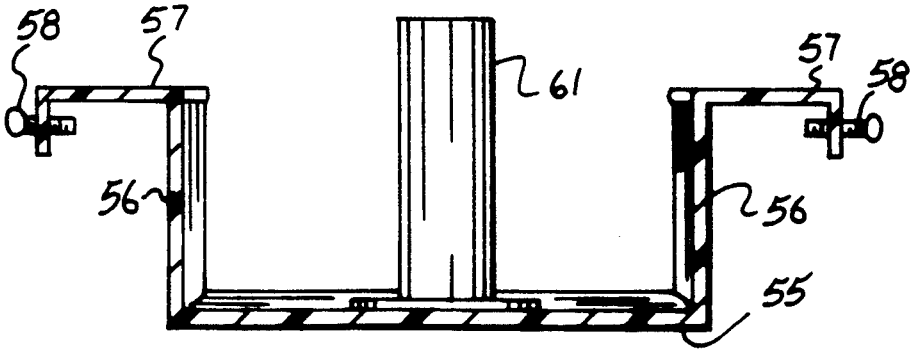

BASS BOAT KIT APPARATUS

BACKGROUND OF THE INVENTION

1. Field of the Invention

The field of invention relates to boat construction, and more particularly pertains to a new and improved bass boat kit apparatus wherein the same is arranged for selectively converting an empty hull into a bass boat configuration.

2. Description of the Prior Art

Bass boats of various types and configurations are utilized in the prior art, but are typically of a limited application in bass fishing. The instant invention attempts to overcome deficiencies of the prior art by providing for inserts arranged for association with a hull member to convert the hull into a bass boat, wherein the inserts are arranged for interlocking relative to one another.

SUMMARY OF THE INVENTION

In view of the foregoing disadvantages inherent in the known types of boat construction now present in the prior art, the present invention provides a bass boat kit apparatus wherein the same utilizes inserts longitudinally aligned and secured relative to one another and to an exterior hull to configure the hull to a bass boat application. As such, the general purpose of the present invention, which will be described subsequently in greater detail, is to provide a new and improved bass boat kit apparatus which has all the advantages of the prior art boat construction and none of the disadvantages.

To attain this, the present invention provides a plurality of inserts arranged for mounting within a hull of a boat member between a bow and stern plate of the hull. The inserts are arranged for mounting to the side walls of the hull and are interlocked relative to one another to convert the hull to a bass boat configuration.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bass boat kit apparatus which has all the advantages of the prior art boat construction and none of the disadvantages.

It is another object of the present invention to provide a new and improved bass boat kit apparatus which may be easily and efficiently manufactured and marketed.

It is a further object of the present invention to provide a new and improved bass boat kit apparatus which is of a durable and reliable construction.

An even further object of the present invention is to provide a new and improved bass boat kit apparatus which is susceptible of a low cost of manufacture with regard to both materials and labor, and which accordingly is then susceptible of low prices of sale to the consuming public, thereby making such boat construction economically available to the buying public.

Still yet another object of the present invention is to provide a new and improved bass boat kit apparatus which provides in the apparatuses and method of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the first insert member.

FIG. 4 is an orthographic view, taken along the lines 4—4 of FIG. 3 in the direction indicated by the arrows.

FIG. 5 is an orthographic view, taken along the lines 5—5 of FIG. 3 in the direction indicated by the arrows.

FIG. 6 is an isometric illustration of the second insert member.

FIG. 7 is an orthographic view, taken along the line 7—7 of FIG. 6 in the direction indicated by the arrows.

FIG. 8 is an orthographic view, taken along the lines 8—8 of FIG. 6 in the direction indicated by the arrows.

FIG. 11 is an isometric illustration of the fourth insert member of the invention.

FIG. 12 is an orthographic view, taken along the lines 12—12 of FIG. 11 in the direction indicated by the arrows.

FIG. 13 is an orthographic view, taken along the lines 13—13 of FIG. 11 in the direction indicated by the arrows.

DESCRIPTION OF THE PREFERRED EMBODIMENT

Figure 1:
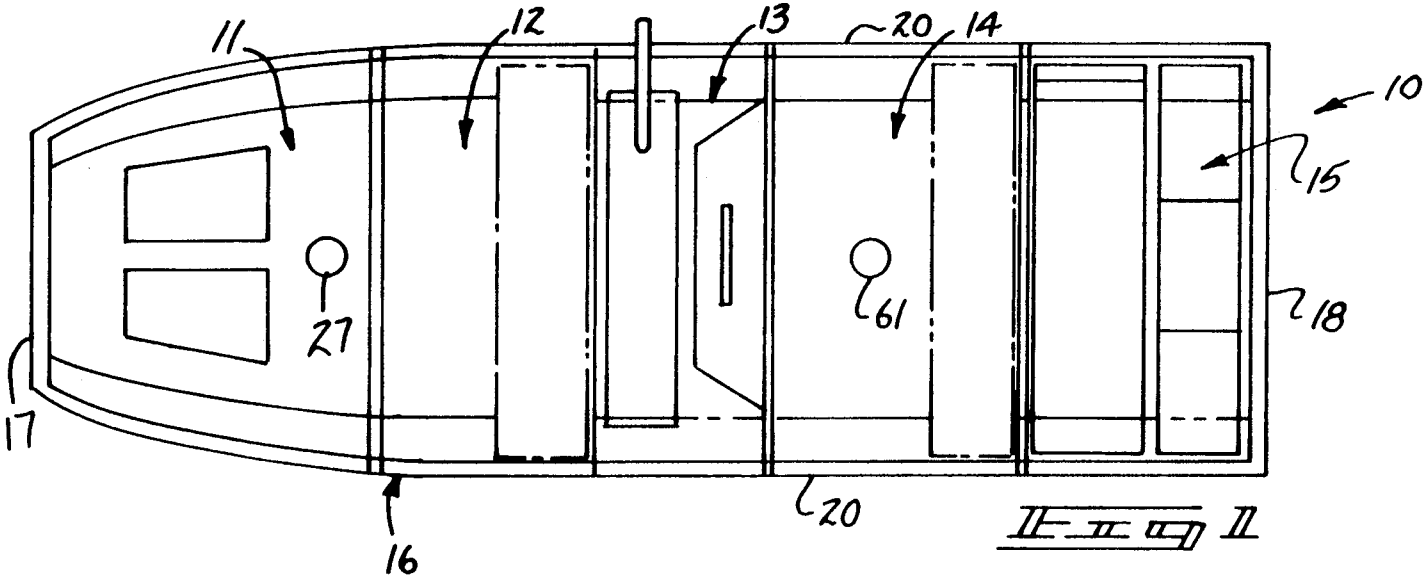
FIG. 1 is an orthographic top view of the completed assembly of the invention.
Figure 2:
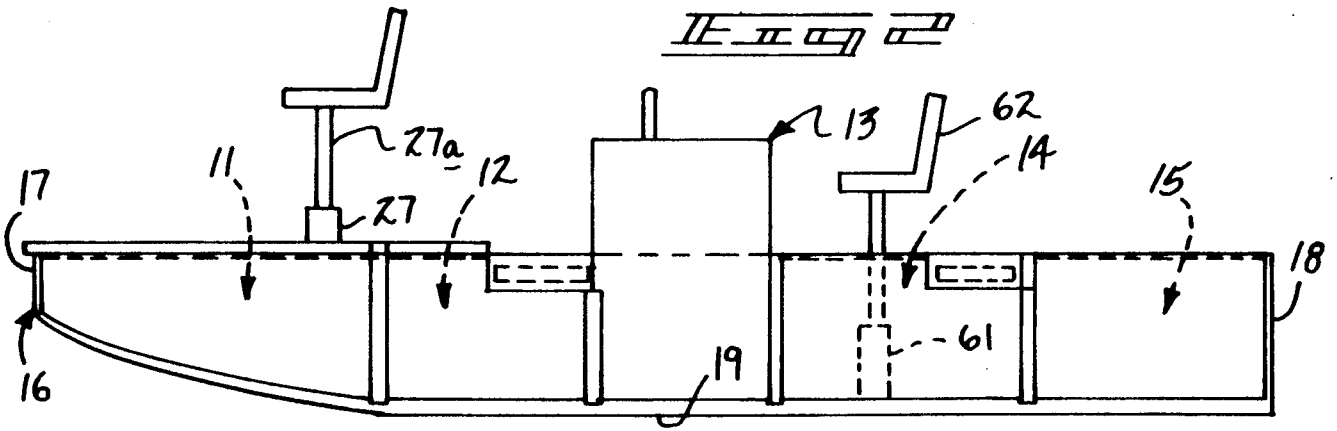
FIG. 2 is an orthographic side view of the invention.
Figure 9:
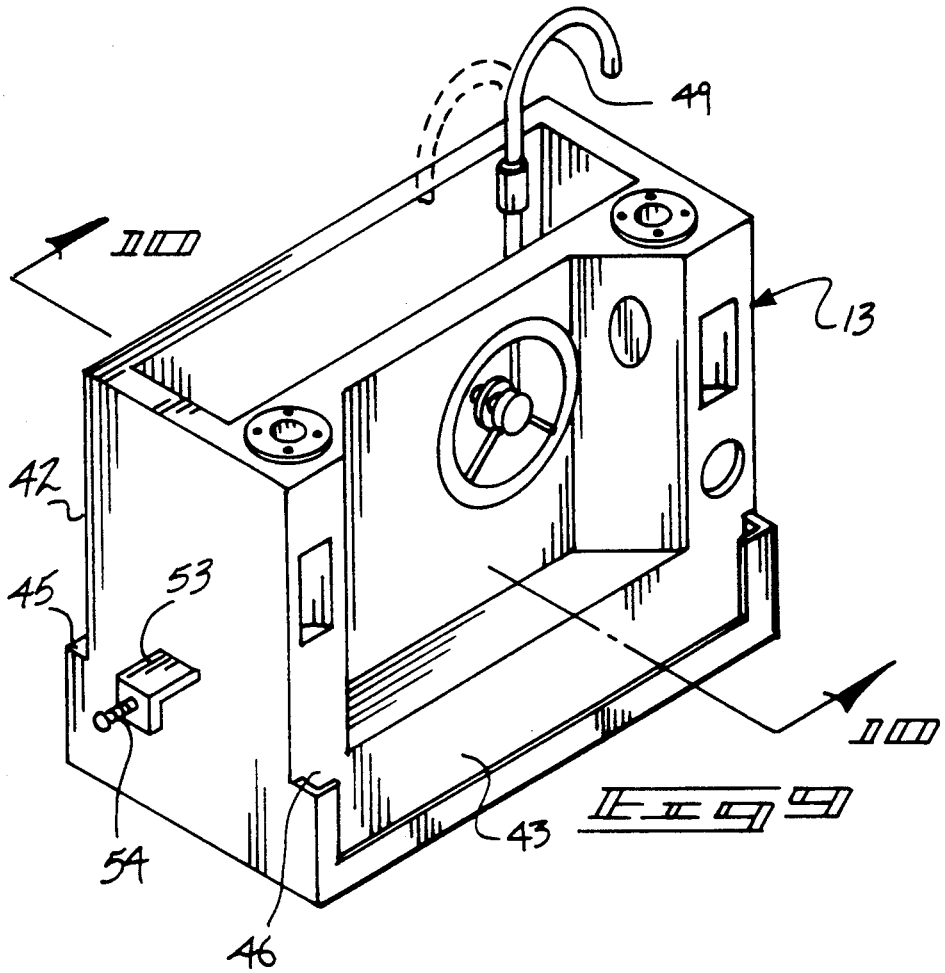
FIG. 9 is an isometric illustration of the third insert member of the invention.
Figure 10:
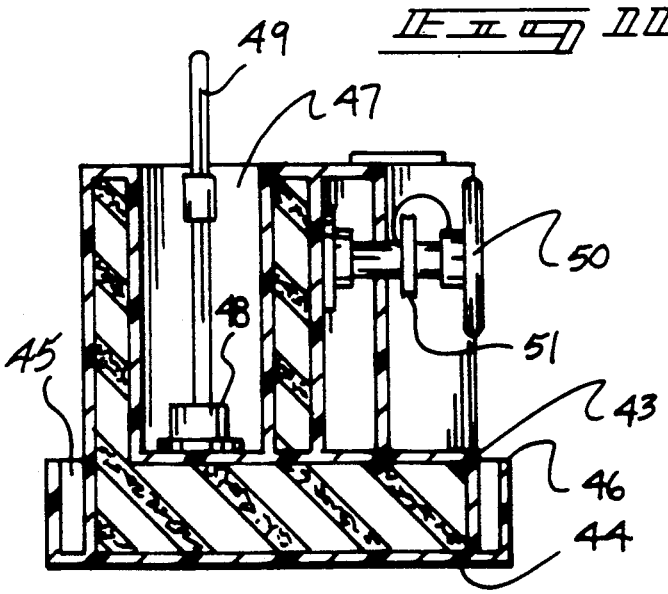
FIG. 10 is an orthographic view, taken along the lines 10—10 of FIG. 9 in the direction indicated by the arrows.
Figure 14:
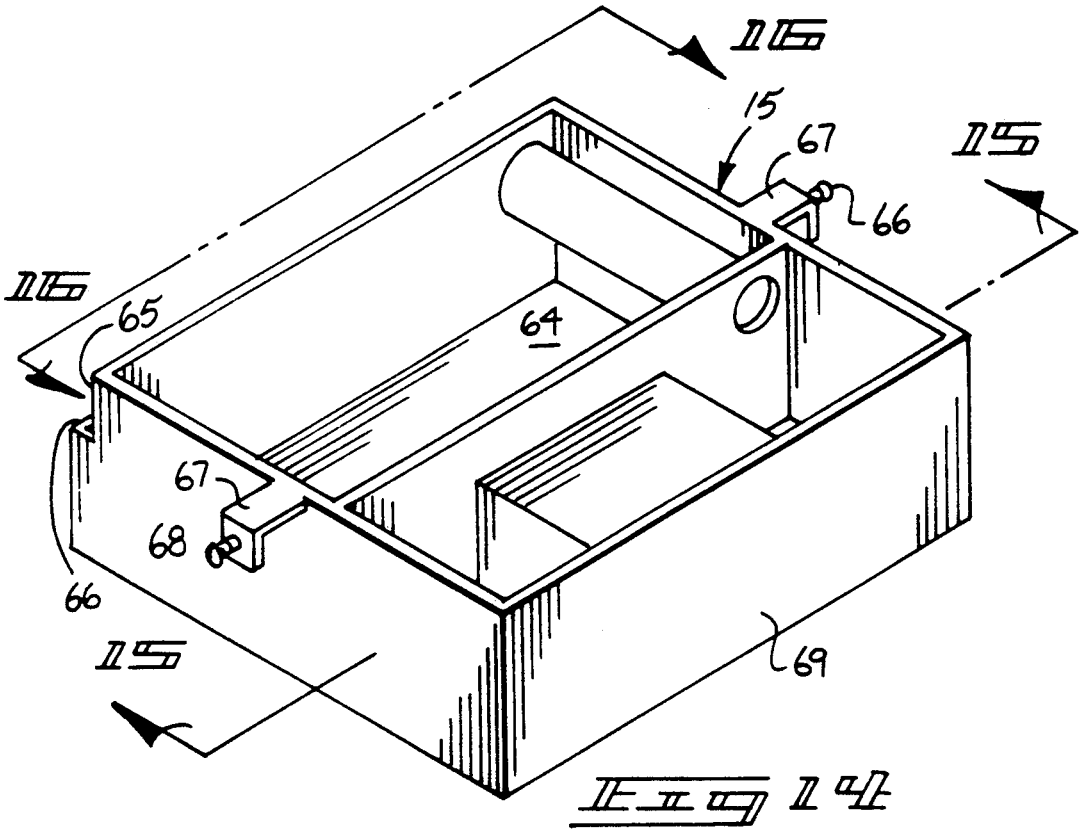
FIG. 14 is an isometric illustration of the fifth insert member of the invention.
Figure 15:
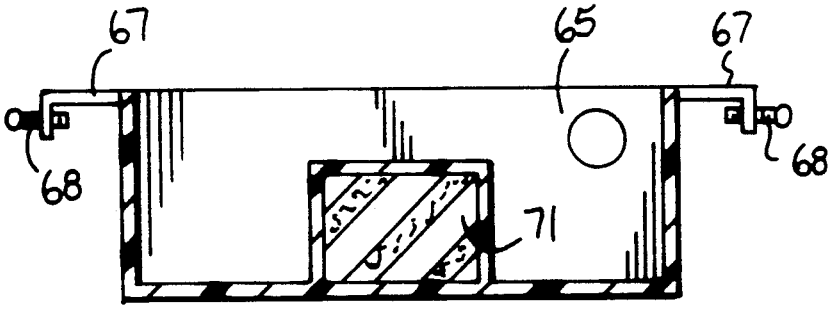
FIG. 15 is an orthographic view, taken along the lines 15—15 of FIG. 14 in the direction indicated by the arrows.
Figure 16:
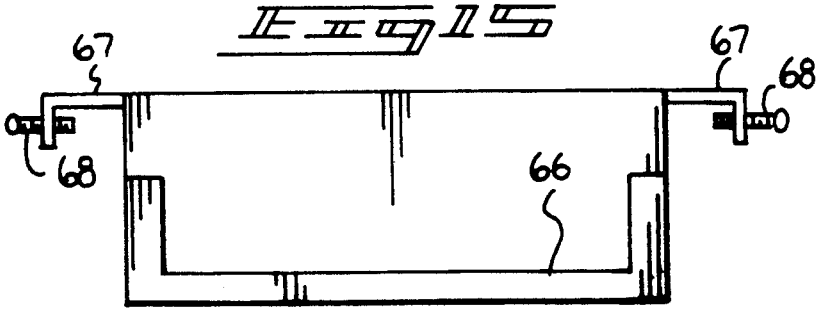
FIG. 16 is an orthographic view, taken along the lines 16—16 of FIG.14 in the direction indicated by the arrows.

With reference now to the drawings, and in particular to FIGS. 1 to 16 thereof, a new and improved bass boat kit apparatus embodying the principles and concepts of the present invention and generally designated by the reference numeral 10 will be described.

More specifically, the bass boat kit apparatus 10 of the instant invention essentially comprises a boat hull 16 having a bow plate 17 spaced from a stern plate 18 spaced apart a predetermined length. The boat hull 16 includes a hull floor plate 19 extending between the bow plate and the stern plate, with hull side walls oriented extending upwardly of the hull floor plate and between the hull stern and bow plates 18 and 17.

Respective first, second, third, fourth, and fifth inserts 11, 12, 13, 14, and 15 extend from the bow plate 17 to the stern plate 18 in a longitudinally aligned orientation interlocked relative to one another and the hull side walls 20, wherein the first insert has a first length, the second insert has a second length, the third insert has a third length, the fourth insert has a fourth length, and the fifth insert has a fifth length, wherein a sum total of the first through fifth lengths is substantially equal to the predetermined length.

The stern includes the first insert side walls 21 arranged for contiguous communication with the hull side walls 20. A first insert front wall 22 is arranged for contiguous communication with the bow plate 17 and substantially coextensive therewith. A first insert rear wall 23 is spaced from and parallel the first insert front wall. A first insert U-shaped trough 24 mounted to the rear wall projects exteriorly thereof, with a first insert top deck 25 oriented to extend laterally beyond the first insert side walls and the first insert front wall 22 for engagement and abutment with the hull side walls 20 and the hull bow plate 17. First insert L-shaped clamp flanges 28 extend from the first insert top deck 25 and each include a first insert fastener rod 29 orthogonally oriented relative to the first insert side walls 21 for engaging and positioning the hull side walls 20 between the fastener rods 29 and the first insert side walls 21. A first insert support tube 27 to receive a chair and chair tube 27*a* rotatably therewithin is orthogonally and fixedly mounted through the first insert top deck 25 and fixedly mounted to the first insert floor plate 26. A polymeric foam first insert 31 is coextensive with the first insert positioned between the first insert top deck 25 and the first insert floor plate 26. It should be further noted that a plurality of storage cavities 30 are provided, each having a door plate 31 directed into the first insert through the first insert top deck 25.

The second insert 12 (see FIG. 6) includes a second insert floor 33 having second insert side walls 34, and a second insert front wall 35 mounting a second insert U-shaped flange 36 received within the first insert U-shaped trough 24 in complementary relationship to longitudinally align the first insert to the second insert 12. A second insert rear wall 37 has a second insert rear wall U-shaped flange 38. Second insert L-shaped clamp flanges 39 extend laterally of a second insert top wall abutment flange 41 for abutment with the hull side walls 20. The second insert clamp flanges further include second insert fastener rods 40 to secure the hull side walls 20 between the second insert fastener rods 40 and the second insert side walls 34. The second insert top wall abutment flange 41 is arranged for coplanar orientation relative to the first insert top deck 25.

The third insert 13 includes a third insert front wall 42 having a front wall U-shaped trough 45 to receive the second insert U-shaped flange 48. The third insert rear wall 43 mounts a third insert rear wall U-shaped trough 46. A third insert floor 44 extends between the front and rear walls, with bilge pump well 47 directed through a top wall of the third insert having a bilge pump 48 therewithin. An outlet conduit 49 is directed from the bilge pump to an orientation exteriorly of the insert. A steering wheel 50 is provided cooperative with a steering wheel pulley 51 to permit mounting of various steering cables thereto for steerage of various drive motors (not shown) for securement relative to the stern portion of the apparatus 10. The third insert side walls 52 each include third insert L-shaped lock flanges 53 having third insert fastener rods 54 to secure the hull side walls 20 between the third insert fastener rods 54 and the third insert side walls 52.

A fourth insert 14 includes a fourth insert forward U-shaped flange 59 for reception with the third insert rear wall U-shaped trough 46. Fourth insert side walls 56 are arranged for communication relative to interior surfaces of the hull side walls 20, with a fourth insert floor 55 extending between the side walls and the forward U-shaped flange 59 and a rear U-shaped flange 60. A fourth insert seat mounting tube 61 is provided to mount a fourth insert seat and seat rod 62 received within the seat mounting tube 61 fixedly and orthogonally mounted to the fourth insert floor 55. Fourth insert side wall lock flanges 57 include fourth insert fastener rods 58 to secure the hull side walls, in a manner as discussed relative to the first, second, and third inserts.

The fifth insert 15 includes a fifth insert floor 64 and fifth insert side walls 63, with a fifth insert front wall 65 having a front wall U-shaped trough 66 receiving the fourth insert rear U-shaped flange 60. Fifth insert side wall lock flanges 67 mount fifth insert lock rods 68 for securement to the hull side walls 20. A fifth insert rear wall 69 is provided, with a flotation chamber 70 directed from the fifth insert rear wall 69 medially of the fifth insert side walls to a partition wall orthogonally directed between the fifth insert side walls. A flotation chamber 70 having a fifth insert polymeric insert 71 is provided between the partition wall and the fifth insert rear wall. In this manner, various drive motors and the like may be mounted relative to the fifth insert rear wall and to the hull stern plate as desirable.

It should be noted that the oriented third insert 13 is further provided with a third insert flotation chamber of polymeric construction, wherein the first, third, and fifth inserts are provided with such flotation chambers to assist in flotation of the apparatus when assembled into a bass boat configuration.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bass boat apparatus, comprising, a boat hull, the boat hull having a bow plate spaced from and parallel a stern plate, and a hull floor plate and hull side walls coextensive between the bow plate and the stern plate, and a plurality of inserts positioned within the boat hull, wherein the plurality of inserts are arranged in a longitudinally aligned orientation relative to one another in contiguous communication relative to one another having a predetermined length, and wherein a spacing between the bow plate and the stern plate is substantially equal to the predetermined length, and the first insert includes a first insert front wall spaced from a first insert rear wall, wherein the first insert rear wall includes a first insert U-shaped trough, and the first insert having a top deck and first insert side walls, wherein the top deck extends laterally beyond the first insert side walls and the first insert front wall, and the first insert top deck includes a plurality of first insert L-shaped clamp flanges and each of the first insert L-shaped clamp flanges includes a first insert fastener rod to secure one of said hull side walls between each said first insert fastener rod and one of said first insert side walls, and the second insert includes a second insert front wall, and the second insert front wall includes a second insert front wall U-shaped flange received within the first insert U-shaped trough.

2. An apparatus as set forth in claim 1 wherein the first insert includes a polymeric foam first insert oriented between the first insert top deck, and a first insert floor plate oriented below the first insert top deck, and wherein the first insert further includes a first insert support tube orthogonally and fixedly directed through the top deck and mounted fixedly to the first insert floor plate.

3. An apparatus as set forth in claim 2 wherein the second insert includes second insert side walls, and the second insert side walls include second insert L-shaped clamp flanges to secure the hull side walls relative to the second insert, and the second insert includes second insert rear wall and the second insert rear wall includes a second insert rear wall U-shaped flange, and a third insert, wherein the third insert includes a third insert front wall and the third insert front wall includes a third insert front wall U-shaped trough receiving the second insert rear wall U-shaped flange therewithin.

4. An apparatus as set forth in claim 3 wherein the third insert further includes a third insert rear wall U-shaped trough, and a fourth insert, wherein the fourth insert includes a fourth insert floor and spaced fourth insert side walls, and the fourth insert further including a fourth insert forward U-shaped flange received within the third insert rear wall U-shaped trough.

5. An apparatus as set forth in claim 4 wherein the fourth insert includes a fourth insert seat mounting tube, and a fourth insert seat having a fourth insert seat tube received within the fourth insert seat mounting tube.

6. An apparatus as set forth in claim 5 wherein the plurality of inserts includes a fifth insert, wherein the fifth insert includes fifth insert side walls, a fifth insert floor, and a fifth insert front wall, wherein the fifth insert front wall has a fifth insert front wall U-shaped trough received within the fourth insert rear U-shaped flange, and the fifth insert further having a fifth insert rear wall and a fifth insert partition wall oriented between the fifth insert rear wall and the fifth insert front wall, and a flotation chamber mounted between the partition wall and the fifth insert rear wall, with the flotation chamber having a polymeric insert therewithin.

* * * * *